US005097851A

United States Patent [19]

Ehling et al.

[11] Patent Number: 5,097,851

[45] Date of Patent: Mar. 24, 1992

[54] TOBACCO SHEET AND METHOD AND APPARATUS FOR THE PRODUCTION OF A TOBACCO SHEET

[75] Inventors: Uwe Ehling, Elmshorn; Jürgen Nüsslein, Wedel; Gerald Schmekel, Elmshorn; Wilfried Stiller, Holm; Werner Hass, Hamburg; Volker Heemann, Reinbek; Casper H. Koene, Hamburg; Arno Weiss, Norderstedt, all of Fed. Rep. of Germany

[73] Assignee: B.A.T. Cigarettenfabriken GmbH, Hamburg, Fed. Rep. of Germany

[21] Appl. No.: 656,380

[22] Filed: Feb. 19, 1991

[30] Foreign Application Priority Data

Feb. 22, 1990 [DE] Fed. Rep. of Germany ..... 4005656
Jan. 16, 1991 [EP] European Pat. Off. ..... 91100471.1

[51] Int. Cl.[5] ..... A24B 3/14

[52] U.S. Cl. ..... 131/375; 131/370; 131/903

[58] Field of Search ..... 131/360, 376, 375, 903

[56] References Cited

U.S. PATENT DOCUMENTS

| | | | |
|---|---|---|---|
| 2,656,841 | 10/1953 | Gurley, Jr. | 131/370 |
| 3,098,492 | 7/1963 | Wurzburg et al. . | |
| 3,957,063 | 5/1976 | Wochnowoski | 131/903 |
| 4,195,647 | 4/1980 | Wochnowski et al. | 131/903 |
| 4,823,817 | 4/1989 | Luke | 131/375 |

FOREIGN PATENT DOCUMENTS

| | | |
|---|---|---|
| 0198718 | 10/1986 | European Pat. Off. . |
| 2804772 | 8/1979 | Fed. Rep. of Germany . |
| 3104098A1 | 1/1982 | Fed. Rep. of Germany . |
| 0046018 | 2/1982 | Fed. Rep. of Germany . |
| 2055672C3 | 6/1983 | Fed. Rep. of Germany . |
| 2421652C3 | 1/1984 | Fed. Rep. of Germany . |
| 3224416C1 | 3/1984 | Fed. Rep. of Germany . |
| 3147846C2 | 7/1984 | Fed. Rep. of Germany . |
| 3339247C1 | 5/1985 | Fed. Rep. of Germany . |
| 3328663C2 | 11/1985 | Fed. Rep. of Germany . |
| 3804459A1 | 9/1988 | Fed. Rep. of Germany . |
| 3804461A1 | 9/1988 | Fed. Rep. of Germany . |
| 3819534C1 | 12/1989 | Fed. Rep. of Germany . |
| 1459218 | 12/1976 | United Kingdom . |

*Primary Examiner*—V. Millin
*Assistant Examiner*—Lynne A. Reichard
*Attorney, Agent, or Firm*—Armstrong, Nikaido, Marmelstein, Kubovcik & Murray

[57] ABSTRACT

With the present invention a tobacco sheet or foil is proposed which has an elevated filling force and consists of tobacco particles, water, binders and moisturizers, and relatively gas-impermeable, in particular surface-sealed cover layers being connected together by a spongy structure which is formed by gas-filled bubbles, and in which cavities are formed having a shaggy, furrowed and/or torn surface.

46 Claims, 5 Drawing Sheets

TOBACCO SHEET AND METHOD AND APPARATUS FOR THE PRODUCTION OF A TOBACCO SHEET

BACKGROUND OF THE INVENTION

1. Field of the Invention

The invention relates to a tobacco sheet of elevated filling power comprising tobacco particles, binder and moisturizer, as well as a method for producing such a sheet and an apparatus for producing such a sheet.

2. Description of the Prior Art

In the production of tobacco sheet or foil pieces from tobacco dust, tobacco fines and the tobacco stamps, it is known to extrude a foam product from said starting materials. A disadvantage here is the relatively high amount required of binders, in particular starch, which can easily lead to impairment of flavour, aroma and burning behaviour of smokable articles.

U.S. Pat. No. 3,098,492 and DE-OS 2,804,772 describe the extrusion of a foil or sheet by means of a slot nozzle; such a method would however be complicated and expensive if it were desired to produce therewith a sheet or foil having a filling power, comparable to tobacco and moreover a high tobacco content and low binder contents. This would be possible only with nozzle gap widths $<0.15$ mm.

A factor here is that the filling power of the tobacco sheet depends decisively on the minimum possible thickness corresponding to a small nozzle gap width of the extrusion nozzle and for this reason the entire tobacco starting material must be present ground reliably to a miximum grain size. Tobacco particles in the raw mass of the tobacco starting material which are too large can easily clog such an extrusion nozzle, entailing complicated monitoring steps or requiring extremely reliable and thus complicated comminution methods.

The production of a sheet or foil by extrusion of the starting material using a slot nozzle in a roller nip is also known from U.S. Pat. No. 3,098,492, DE-OS 2,804,772 and GB-PS 1,459,218. In these cases as well, the aforementioned disadvantages of the low filling power compared with leaf material occur. In addition, the rollers forming the gap when operating with a slot nozzle can run with only a small peripheral speed and consequently a high torque is necessary, leading to high strain of the roller structure for relatively low throughput. An increase in the throughput can only be achieved by increasing the roller width; this in turn requires an extremely large slot nozzle, a stable roller structure and a large roller thickness in order to minimize the sagging of the rollers. Moreover, as a rule a multiple calender must be used because a single deformation step does not suffice for achieving the uniform required thickness.

In another known method (DE-OS 3,104,098, DE-PS 2,055,672, DE-PS 2,421,652, DE-PS 3,224,416 and GB-PS 1,459,218), of making tobacco foils or sheets by means of rollers or rolls, an extremely high amount of water must be added to the starting material, in the range of 30 to 50%, making subsequent drying necessary. This increases the necessary technical expenditure for the method. Moreover, in this case frequently undesired organic solvents are used, for example methylene chloride. Finally, in this case as well as a rule a multistage rolling apparatus or a calender is required.

A method and apparatus for reprocessing tobacco is known from DE-PS 3,339,247. Dust-like tobacco particles are worked with binders and possibly additives to give a plastifiable mixture which is extruded to form individual rodlike intermediate products. Said rodlike intermediate products are then processed to sheet pieces by reforming a cylindrical skein from the plasticized mixture in an extruder to a thin-walled continuously widening hollow body and split into threadlike intermediate products which become crimped. The threadlike crimped intermediate products are then cut to give the individual crimped fibre pieces. The intermediate products have a relatively dense structure which moreover due to the additives differs from the quality features of natural tobacco.

DE-OS 3,804,461 discloses a tobacco reconstitution method in which a mixture of tobacco particles, starch and binders is extruded with addition of water to form a striplike extrudate, the extrusion conditions and the recipe being such that the extrudate on leaving the exit aperture of the extruder nozzle assumes a cross-section which is greater than that of the exit aperture of the extruder nozzle, and the extrudate is stretched in its plastic phase to reduce its thickness dimensions, the stretching ratio being at least 1.5; the stretched extrudate is cut to give particles which each have a cellular structure and an integral skin. The stretching or drawing operation here is relatively complicated. If tearing of the tobacco sheet occurs in this case it leads to a loss of time and material during the production. Another disadvantage is the necessary high amount of binder, leading to impairment of the flavour and aroma.

DE-OS 3,804,459 discloses a tobacco reconstitution method in which a mixture of tobacco particles, starch and binder as well as water is supplied to an extruder, the operating conditions and the recipe being such that the water escapes from the striplike extrudate by evaporation in order to thereby expand the extrudate. After the cooling the extrudate is cut into particle size. The particles, each of which has a cellular inner structure and a skin on two oppositely disposed sides may be used as or in cigarette filling material. However, a disadvantage with this tobacco reconstitution method, as already indicated, is that large amounts of starch and binders are necessary and this leads to changes in the flavour and aroma of the tobacco material.

DE 33 28 663 C2 discloses a filling material of reconstituted tobacco material and a method for the production thereof. In this case, two separate sheet sections are locally adhered together, cavities forming between the two adhered sheet sections. This procedure is complicated, troublesome and provides sheet material of only low filling capacity. Moreover, the apparatus for carrying out the known method is complicated and involved.

DE 31 47 846 C2 relates to a method or a tobacco material with which by increasing the cell structure of the tobacco through a pressure reduction and pronounced temperature increase an expansion is achieved. However, such a method is possible only with natural tobacco material and is not suitable for reconstituted tobacco material because in this case no expandable cell structures are available.

EP 0 198 718 A2 discloses a method with which a reconstituted tobacco material of tobacco waste is expanded during the extrusion. The expansion is effected by a high extrusion temperature and an abrupt pressure reduction on leaving the extruder in conjunction with an adequate sheet thickness and a content of binder of at least about 10%. This production method is obviously based on completely different principles and also gives a completely different product which due to its high binder content is very unsatisfactory as regards its flavour, burning properties and the like.

EP 0 046 018 A1 also discloses a method for producing reconstituted tobacco material. However, this method is based only on the stiffening of the material and fixation of the stiffening. The reconstituted tobacco material is greatly overdried and thereafter again moisturized. As a result, the reconstituted tobacco material loses a greater part of its flavouring substances and becomes extremely critical in its handling because with increasing drying it becomes extremely brittle and friable. This method thus also results in a product which is unsatisfactory.

DE 38 19 534 C1 describes a thin compact tobacco product without air inclusions in which by extrusion a plurality of material rods or skeins are formed which are then rolled together again to form a monoply material layer.

SUMMARY OF THE INVENTION

The invention therefore has as its object the provision of a sheet with increased filling power in the production and consumption of which the disadvantages of the prior art set forth above do not occur, as well as an apparatus and a method in particular for producing such a tobacco sheet.

More especially, the invention has as its object the production of a sheet which is completely or almost completely satisfactory in the factors flavour, aroma, colour, ash and smoke properties, density, elasticity and fragility, so that the properties thereof hardly differ from those of the tobacco; furthermore, the objective is to provide a method and an apparatus with which it is possible to make such a sheet in simple manner.

The invention therefore proposes in a sheet of elevated filling power comprising tobacco particles, water, binder and moisturizer the improvement wherein the outer surfaces of the sheet are formed by two relatively gas-impermeable, in particular surface-sealed cover layers; between the cover layers there is a layer of spongy structure; and the layer includes a ply of lenticular gas-filled cavities with shaggy, furrowed and/or torn surface.

The invention further proposes in a method for producing such a sheet containing tobacco and having elevated filling power wherein a raw mass having a tobacco content, a content of moisturizers and a binder content is mixed with a water content in the ratio of 80:20 to 60:40, preferably 70:30; the moist raw mass is extruded with an extruder at a temperature of about 160° C., preferably up to about 140° C., under pressure and formed to a tobacco sheet, the improvement in which the tobacco content of the raw mass is about 86 to 98% by weight, the moisturizer content about 1 to 6% by weight and the binder content about 1 to 8% by weight; the forming pressure lies between about 10 and 200 bar, preferably between 50 and 100 bar; the tobacco sheet is strongly heated from both sides after the forming, substantially gas-impermeable cover layers thereby forming on the tobacco sheet; and by a further intense supply of heat the water disposed in the tobacco sheet between the cover layers evaporates, gas-filled lenticular cavities and gas-filled bubbles thereby being formed.

The invention also proposes in an apparatus for producing a tobacco-containing sheet, comprising an extruder having a nozzle the improvement in which the nozzle is followed by an expansion chamber through which tobacco sheet formed by the extruder is led; the expansion chamber is connected to a heat source in such a manner that the tobacco sheet passing through the expansion chamber is intensely heated from both sides so as to form relatively gas-impermeable cover layers, and a spongy intermediate layer having bubbles and lenticular cavities.

Advantageous and expedient embodiments or variants are defined by the features in the subsidiary claims.

A raw mass of tobacco particles, water, binder and moisturizers is processed to the sheet according to the invention which consists of two relatively gas-impermeable in particular surface-sealed cover layers at the outer surfaces, the cover layers being connected together via a spongy structure containing gas-filled bubbles; gas-filled cavities are formed between the cover layers, said cavities being provided with a shaggy, furrowed and/or torn surface. In its burning behaviour the tobacco sheet or foil according to the invention is in some cases better than average tobaccos.

By the two relatively gas-impermeable, in particular surface-sealed cover layers it is possible on the one hand during the production process to generate an extremely high expansion pressure within the tobacco sheet and on the other to retain the filling power increase obtained in this manner for very long periods of time.

Decisive in obtaining the desired quality factors, flavour, aroma and colour, is that at least about 85% by weight, in particular 92% by weight, tobacco particles are present in the raw mass processed to the tobacco sheet or foil according to the invention. In this manner, the extremely cost-intensive tobacco can be processed almost without waste to give high-quality smokable articles.

To ensure a necessary elasticity and a strength of the tobacco sheet comparable to the natural leaf, it is advantageous to make the tobacco sheet having a moisturizer content of about 1 to 6% by weight, in particular 2 to 5% by weight, so that said tobacco sheet can retain a certain moisture content of about 10 to 14% (wet basis) after the production and even for relatively long periods of time. If this residue of moisture were too low, it would not be possible to carry out an extensive further processing of the tobacco sheet.

Disregarding the contribution of the cavities, the thickness of the sheet should lie between about 0.1 mm and 0.4 mm; in particular, sheet thicknesses between 0.2 and 0.3 mm are advantageous in order to ensure a contribution to the desired natural tobacco features.

The binder should not contain more than about 2% by weight starch at the most in order to avoid the occurrence of any disadvantageous changes in the flavour and aroma of the sheet.

To obtain the expansion effect according to the invention it is not absolutely essential to add starch.

To give the tobacco sheet according to the invention the physical properties of natural tobacco material as far as is possible, it is advantageous to use as moisturizer glycerol and/or 1,2-propylene glycol and/or sorbitol.

These advantages for the tobacco sheet can be further achieved in that the binder contains carboxymethyl cellulose, carboxymethylated and/or hydroxyethylated and/or agar-agar and/or alginic acid or their sodium, potassium and/or calcium salts and/or tragacanth and/or guar seed flour and/or pectin and/or carob seed flour and/or gum arabic.

The cavities generated in the layer of the tobacco sheet may in principle have any desired size relatively to the sheet size. With regard to a nature-identical burning behaviour, the filling power, and other features of burning tobacco, extents of the cavities in the sheet thickness have proved advantageous which are of the magnitude of about 0.1 mm to 5 mm and in the direction of the sheet width of about 0.1 to 10 mm, in particular from 1 to 5 mm.

To produce the tobacco sheet according to the invention with elevated filling power a raw mass is processed which consists of about 86 to 98% by weight tobacco material, of a content of moisturizers of about 1 to 6% by weight and a binder content of about 1 to 8% by weight. This raw mass is mixed with a water content of about at least 20%, in particular 20 to 40%, preferably 30% (all wet basis). The raw mass is extruded at a pressure of about 10 to 200 bar, preferably between 50 and 100 bar, to give the tobacco sheet, the extruder having a temperature profile of about 30° C. to 160° C. Preferably, a temperature profile of 40° C. to 140° C. is used. The raw mass is expelled at the extruder outlet through a nozzle provided with exit gaps, thereby forming the tobacco sheet. The tobacco sheet is thereafter strongly heated from both sides in a relatively short time, thereby forming relatively gas-impermeable cover layers. By a further intense supply of heat the water disposed in the tobacco sheet in the layer between the cover layers is evaporated, thereby forming gas-filled cavities and bubbles.

Advantageously, the method step for forming the relatively gas-impermeable cover layers and the bubble-like cavities may be combined to one method step, this greatly reducing both the method technology involved and the apparatus expenditure. As nozzle die slot or ring nozzles may be employed.

If a ring nozzle is used as nozzle a continuous tobacco sheet hose can be produced which is advantageously provided at the ring nozzle gap with a plurality of cutters, the tobacco sheet thereby being cut into longitudinal strips preferably emerging as endless strips, in particular with a width of about 3 to 5 cm, from the nozzle mouth. A tobacco sheet prepared in this manner can be further processed particularly effectively and without excessive apparatus expenditure. To largely eliminate any clogging of the nozzle slot or ring nozzle slot, the raw mass constituents which are larger than the exit gap width of the nozzle or ring nozzle used should be comminuted to correspond to the exit gap width and this can for example be ensured by a mill preceding the extruder for comminuting the raw mass constituents which are too large.

A particularly simple method procedure is possible if the heat supply is produced by a hot air stream. The temperature of the latter should be about 200° to 800° C., depending on the process duration and the desired expansion. In a test apparatus it has been found that hot-air temperatures of about 300° C. to 400° C. suffice to obtain satisfactory expansion excelling the prior art.

Comparable advantages can also of course be achieved with other heat sources of suitable energy density. Such heat sources may for example be infrared radiators, microwave generators or hot gases.

To treat the sheet foil uniformly from the inside and outside it is advantageous to supply hot air or hot gas to the tobacco sheet hose both from the outside and from the inside and this can for example be done from the outside by an annular nozzle which surrounds the tobacco sheet hose and can be assisted by a hot-air lance which introduces hot air into the interior of the tobacco sheet hose. If the sheet hose is divided by the cutting pins installed in the apparatus according to the invention into longitudinal strips it is ensured even without a lance that hot air flows into the interior of the sheet hose. Of course, as a rule the air and gas amounts supplied are regulatable. The regulation is for example carried out by means of valves or adjustable fans. Usually, the air and gas amounts supplied from the inside and outside will be of substantially the same size.

The heat supply is controlled in such a manner that the tobacco sheet end product retains a residual moisture of about 10 to 20% (wet basis). A lower moisture content of the tobacco sheet would lead to said sheet breaking during the heat treatment itself or disintegrating in a subsequent method step into components which are of no use.

The endless tobacco sheet strips are cut immediately after the heat treatment into pieces about 5 to 20 cm in length which are then either separately cut to filaments, the cut width being about 0.5 to 1.5 mm, or cut together with a leaf tobacco.

To avoid possible occurring clogging of the nozzle or ring nozzle exit gap, the gap halves are automatically displaced or turned from time to time with respect to each other, the clogging nucleii thereby being detached by the shearing forces rising.

If a ring nozzle is used, as is preferably the case with the present invention, the inner part of the ring nozzle is adjusted by means of a centering screw in such a manner that the tobacco sheet hose emerging from the nozzle mouth has substantially the same wall thickness everywhere.

To avoid clogging of the extrusion nozzle slot it is also possible to subject the nozzle intermittently or permanently to ultrasonic radiation. The vibrations occurring loosen the clogging present or prevent the formation of clogging nucleii.

To take account of irregularities at the start or end of a production sequence (for example of a working day) it is expedient to vary the exit gap width at the nozzle when starting or shutting down the extruder. In this manner initially occurring viscosity fluctuations in the raw mass can be compensated. The same applies when the extruder is shut down.

It may possibly be advantageous not to seal the tobacco sheet surface with hot air or gas but to apply a thin layer which is applied before the expansion. This may for example be expedient when the raw mass has to be treated particularly gently. Thus, for example, by applying water glass and subsequent heating it is certainly possible to obtain advantageous expansion results.

Furthermore, it is also possible to add to the raw mass gas-forming or propellant chemicals, such as sodium hydrogencarbonate, ammonium hydrogencarbonate and the like, so as instead of the water vapour or in combination therewith to effect the bubble formation after formation of the skin.

Preferably, however, additional layer application or also gas-forming chemicals are dispensed with because the addition or application of these substances can disadvantageously alter the nature-identical features of the tobacco sheet.

An apparatus according to the invention for producing a tobacco sheet and comprising an extruder is implemented in that to an extruder a nozzle is connected through which the extruded raw mass is forced in order to be subsequently treated with heat in an expansion chamber.

To enable the advantage of making the nozzle or ring nozzle less or hardly prone to clogging, the inner part of the nozzle should be mounted in a bearing with respect to the outer part. As a result the two gap halves of the nozzle can easily be turned with respect to each other, thereby diminishing clogging nucleii or avoiding them. To achieve a uniform foil or sheet thickness the mouthpiece of the nozzle can be centred. The gap width of the nozzle is adjustable.

The cutters and other wearing parts of the apparatus are mounted for easy replacement.

For the heat treatment process the expansion chamber must be provided with at least one connection for the supply of hot air or hot gas. Preferably, at the expansion chamber, which preferably has a tubular cross-section, at least one connection for the supply of hot air or hot gas is provided and substantially annularly surrounds the expansion chamber, as well as a hot-gas or hot-air supply means which is substantially centrically arranged in the expansion chamber. It is not so much the central arrangement in the expansion chamber which is important as the central arrangement of the hot-gas or hot-air supply means within the tubular tobacco sheet.

A particularly troublefree and effective operation of the apparatus can be achieved if the exit apertures of the annular hot-gas supply and the connection for the central supply of hot air or hot gas are arranged in such a manner that they are substantially opposite each other. Of course, the hot-gas supply means can also be arranged staggered along the expansion chamber. However, as a rule it suffices to provide an elongated expansion chamber with less connections and a central hot-gas supply.

In one experimental arrangement the central hot-gas supply consists of a lance-shaped valve in which the hot-gas outlet has a mouthpiece which has the same but laterally inverted longitudinal symmetry as the hot-gas supply means annularly surrounding the expansion chamber and as a result the hot-gas jet emitted by the central hot-gas supply means is substantially in laterally inverted symmetry with the hot-gas jet which comes from the annular hot-gas supply means, the tobacco sheet representing the surface of mirror inversion.

In other experimental arrangements, by the slit sheet hose and appropriate flow guiding it is ensured even without central hot-gas supply that adequate hot air reaches the interior of the sheet hose.

To ensure continuous operation it is expedient to arrange behind the expansion chamber a conveyor belt which conveys the tobacco sheet or the endless tobacco sheet strips to a cutter mechanism which cuts the endless tobacco strips into tobacco pieces of the desired size.

BRIEF DESCRIPTION OF THE DRAWINGS

The invention will be described in more detail hereinafter with reference to some examples of embodiment illustrated in the drawings, from which further advantages and features are apparent and in which.

DESCRIPTION OF PREFERRED EMBODIMENTS

Figure 1:
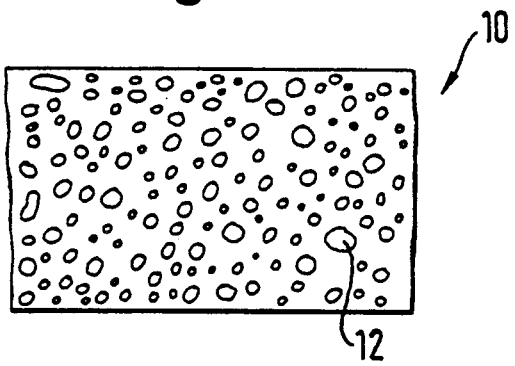
FIG. 1 is a plan view of a tobacco sheet strip.

In FIG. 1 a tobacco sheet strip denoted generally by the reference numeral 10 can be seen. On the surface of the tobacco sheet or foil strip 10 blister-like protrusions 12 can be seen. These are extremely different in their thickness as can be seen from FIG. 2. FIG. 3 also shows a tobacco sheet strip 10 having gas-filled cavities 12. The raw mass from which the tobacco sheet strip 10 is made has a content of at least about 86% by weight tobacco particles. To give the tobacco sheet 10 the necessary moisture content, about 1 to 6% by weight, in particular 2 to 5% by weight, moisturizers are contained therein. The necessary mechanical cohesion of the tobacco sheet 10 is achieved by a content of binder of about 1 to 8% by weight, in particular 3 to 6% by weight. The thickness of the tobacco sheet 10 without the cavities lies between about 0.2 mm and 0.4 mm, in particular between 0.2 and 0.3 mm. The starch proportion of the binder should be about 2% by weight at the most, if indeed starch is provided at all. To retain the necessary elasticity of the tobacco sheet 10 a moisturizer is used which may consist for example of glycerol and/or propylene glycol and/or sorbitol or the like.

The binder may for example contain carboxymethyl cellulose, carboxymethylated and/or hydroxyethylated and/or agar-agar and/or alginic acid or their sodium, potassium and/or calcium salts and/or tragacanth and/or guar seed flour and/or pectin and/or carob seed flour and/or gum arabic.

The cavities 12 illustrated and defined by a spongy structure 16 have as a rule in the direction of the sheet thickness an extent of about 0.1 to 5 mm and in the direction of the sheet width of 0.1 mm to about 10 mm, in particular 1 to 5 mm. The spongy structure is formed by relatively small bubbles or blisters 19 in the foundation material. The thickness of the relatively gas-impermeable in particular surface-sealed cover layers 14 is usually extremely small because the cover layers and the spongy structure 16 make a contribution of 0.2 to 0.4 mm to the aforementioned total thickness of the sheet.

The cavities 12 disposed within the spongy structure 16 have a shaggy, furrowed and/or torn pitted surface 17.

Figure 2:
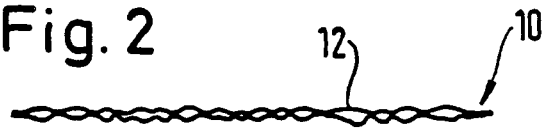
FIG. 2 is a longitudinal section through the tobacco sheet strip.
Figure 3:
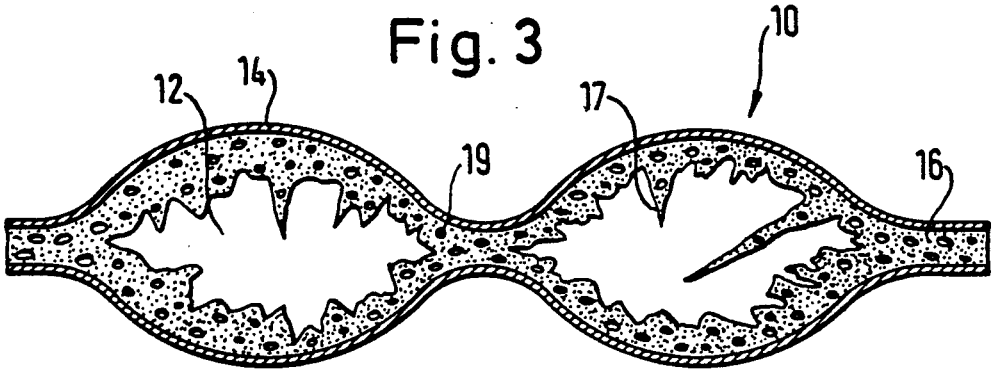
FIG. 3 is an enlarged perspective longitudinal section through the tobacco sheet strip according to the invention.
Figure 4:
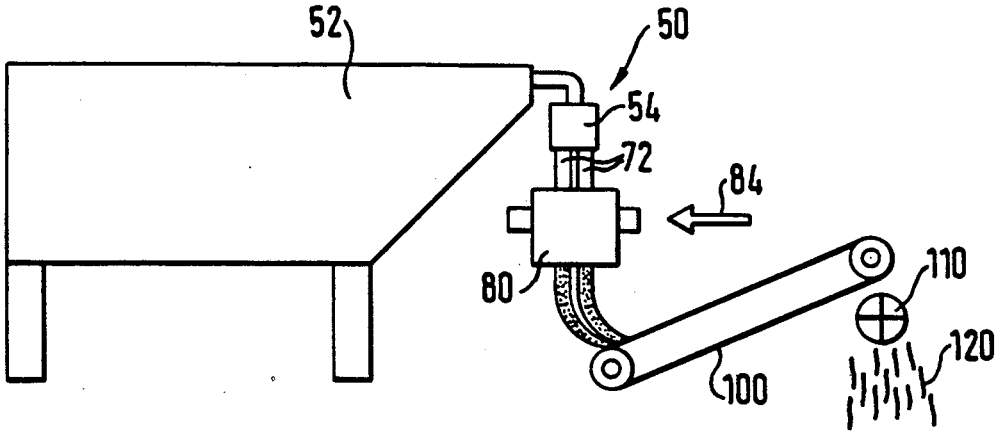
FIG. 4 is a schematic illustration of an apparatus according to the invention, in particular for carrying out the method according to the invention.

FIG. 4 shows an apparatus which can be used to make the tobacco sheet according to FIGS. 1 to 3.

In the extruder 52 a raw mass consisting of a tobacco content of about 86 to 98% by weight, a content of moisturizers of about 1 to 6% by weight and a binder content of about 1 to 8% by weight is thoroughly mixed and using for example a mill larger paricles are comminuted so that they cannot clog the nozzle exit gap 62 in a nozzle 54. In the extruder 52 the raw mass is mixed with a water proportion of at least 20 to 40%, preferably 30% (water contents are indicated with respect to the wet basis). This raw mass is extruded at a pressure of about 10 to 200 bar, preferably between 50 and 100 bar, a temperature profile of about 30° C. to 160° C., preferably 40° to 140° C., being applied to the extruder 52.

The pressure forming in the extruder expels the raw mass through the exit gap 62 of the nozzle 54, giving the tobacco sheet 72.

The tobacco sheet 72, which is hose-shaped when using a ring nozzle 54, is now introduced into an expansion chamber where it is initially strongly heated from both sides so that relatively gas-impermeable cover layers form. The bilateral heating initially leads due to a quasi surface plastifying to an increase of the diffusion/-flow resistance of the cover layers. This first heating operation in the expansion chamber 80 may be relatively short or alternatively merge directly into a further intense supply of heat. On this further intense supply of heat in the expansion chamber 80 an evaporation rate of the liquid phase present is produced having a vapour formation gradient sufficient to build up gas pressures between the previously treated cover layers which are able to form monoply gas bubble structures between the prepared cover layers. The heat supply may for example be via hot air or hot gas and is indicated by the arrow 82 in FIG. 4.

The expanded tobacco sheet 72 emerging from the expansion chamber 80 is placed on a conveyor belt 100 and conveyed by the latter to a cutter mechanism 110. The cutter mechanism 110 processes the tobacco sheet strips 72, which are preferably present as endless strips and in particular have a width of about 3 to 5 cm, to give sheet strips 120. The latter are as a rule 5 to 20 cm long and may subsequently be cut separately or together with tobacco leaves to give filaments.

During the skin formation process and during the expansion process temperatures between about 200° to 800° C. obtain in the expansion chamber 80. Preferably, the operation is carried out with temperatures of 300° to 400° C. Other suitable heat sources may also be used, for example infrared radiators or microwave generators as sole energy dispensers or in combination with hot-gas supply.

To the raw mass in the extruder 52 gas-developing or propellant chemicals may also be added, for example sodium hydrogencarbonate, ammonium hydrogencarbonate and the like. This can be done in amplification of the admixture of water in an amount of at least about 20 to at the most about 40% (with respect to the wet basis).

Immediately prior to the heat treatment in the expansion chamber 80 a sealing layer could also be applied to the tobacco sheet surface.

It will of course be clear to the person skilled in the art that the desired advantages do not appear abruptly on modification and deviation from the orders of magnitude and quantity ratios specified.

Figure 5:
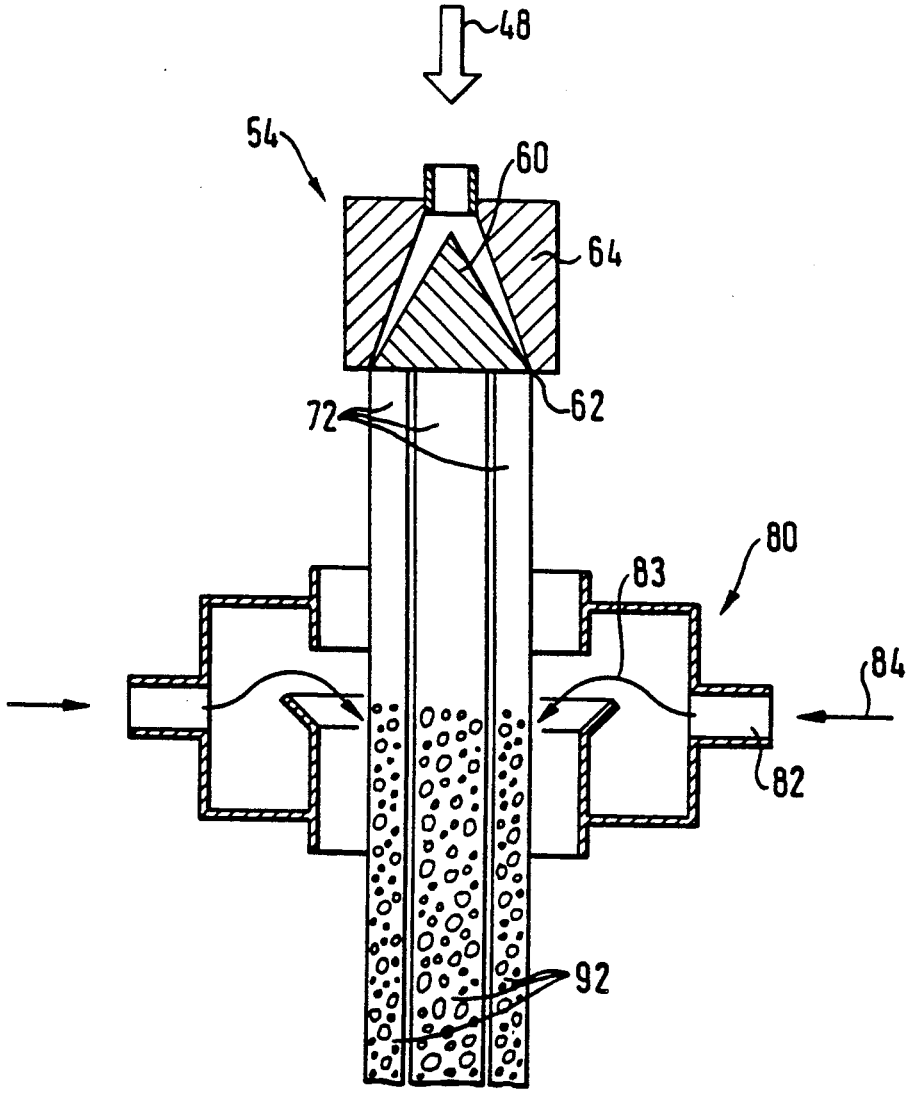
FIG. 5 is a longitudinal section through a ring nozzle and expansion chamber in schematic representation.

The nozzle pictured in FIG. 5 is a ring nozzle 54. The raw mass is introduced by the extruder 52 into said nozzle from above as indicated by the arrow 48. The raw mass is forced through the intermediate space between the inner part 60 and the mouthpiece 64 in the direction towards the nozzle exit gap 62 and forced through the latter. The corresponding tobacco sheet 72 is subsequently introduced into the expansion chamber 80. There it is heated by means of hot air or hot gas which enters the expansion chamber 80 through the supply means 82. The hot air is directed along the arrows 83 onto the tobacco sheet 72, 92, thereby forming the relatively gas-impermeable cover layers on the surface of the tobacco sheet immediately after the expansion of said sheet. The expanded tobacco sheet 92 leaves the expansion chamber 80 on the opposite side.

Figure 6:
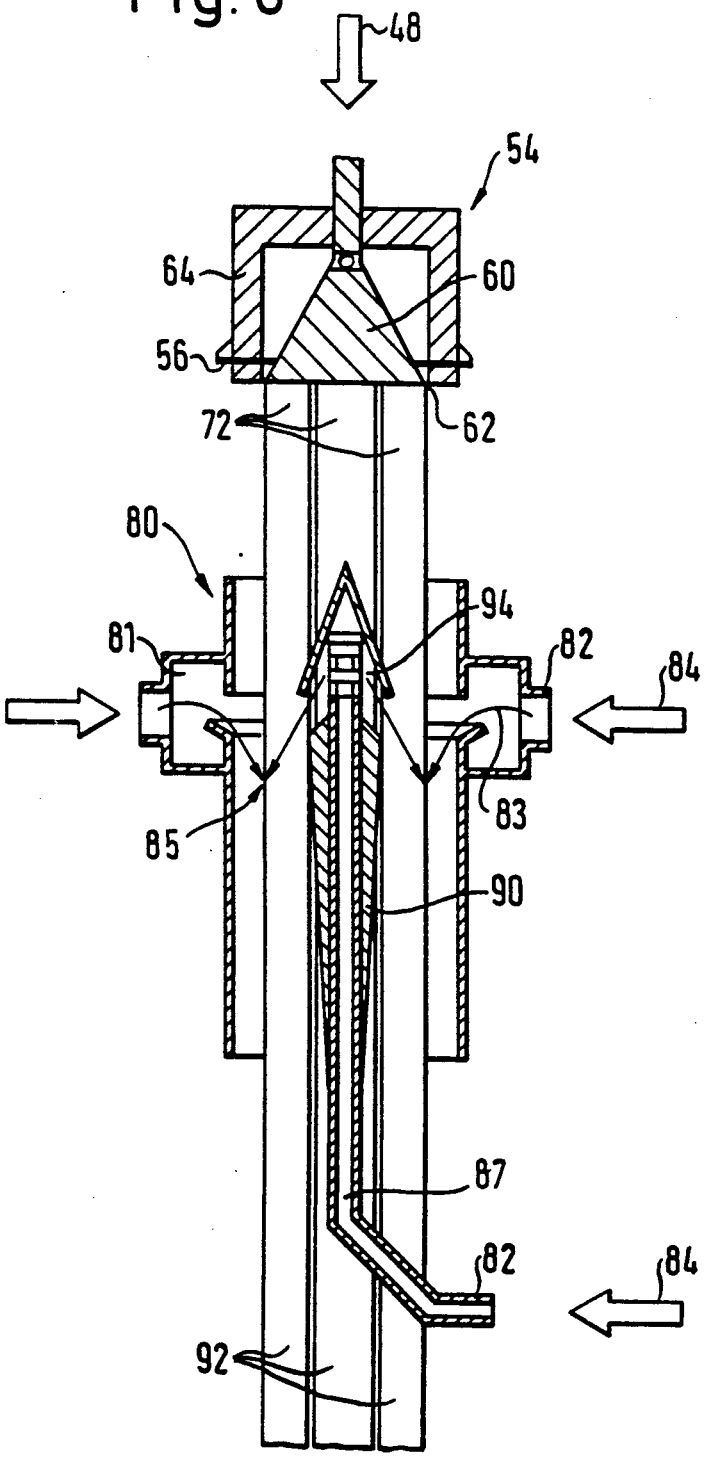
FIG. 6 is a schematic longitudinal section through a preferred example of embodiment of the ring nozzle and a tubular expansion chamber.

In FIG. 6 fundamentally the same arrangement as in FIG. 5 is shown but in this case in more detail and with the inner hot-air lance 90. In this case as well the raw mass from the extruder 52 enters the ring nozzle 54 as indicated by an arrow 48. The raw mass is forced between the mouthpiece 64 and the inner part 60 of the ring nozzle 54 and is cut by cutters 56 to form strips. These tobacco sheet strips arrayed in hose-like manner are now introduced into the tubular expansion chamber 80. Hot air or hot gas 84 is introduced via the connections 82 into the expansion chamber 80. A lance-like member 90 ensures that the hot air or hot gas is also available uniformly for the treatment of the inner surface of the tobacco sheet. The hot air or hot gas amounts from the annular hot-gas supply means and the centrically arranged lance-like hot-air or hot-gas supply means are proportioned so that the tobacco sheet 72 present in strips is subjected only to a minimum mechanical load radially inwardly or outwardly. The flow vectors of the hot air or the hot gas to which the sheet is subjected to form the substantially gas-impermeable skin and effect the expansion process are directed in the direction of movement of the sheet through the expansion chamber.

The central hot-gas supply means consists of a lance-like hot-gas supply means 90 in which the hot-gas outlet 94 has a mouthpiece which has the same longitudinal sectional symmetry as the annular hot-gas supply means 81 and/or the expansion chamber 80, although in laterally inverted form, and as a result the hot-gas jet emitted by the central hot-gas supply means 90 is substantially in laterally inverted symmetry with the hot-gas jet coming from the annular hot-gas supply means 81; the tobacco sheet 72, 92 represents the mirror surface of said symmetry.

By means of the ring nozzle 54 illustrated here a tobacco sheet tube slit into strips has been extruded and has a wall thickness of 0.2 mm. The sheet strips 72 passed with a velocity of for example $v=0.06$ m/s through the expansion chamber 80 which had a diameter of 100 mm and a length of 200 mm. As this was done, air at a temperature of about 300° C. was blown by two hot-air fans via conduits 82 with volumes of 500 l /min each onto the foil strips. From the inside the sheets were simultaneously subjected to hot air at about 300° C. in substantially the same amount through a hot-air lance with a hot-air fan. The tobacco sheet strips entered the expansion chamber 80 with a moisture content of about 40% and left said chamber with a moisture content of about 14%.

To achieve the expansion effect to an advantageous extent it is necessary to transfer the heat to the tobacco sheet 72, 92 in the shortest possible time to avoid the evaporating moisture from escaping from the tobacco sheet or diffusing out of said sheet slowly without generating the expansion effect.

Figure 7:
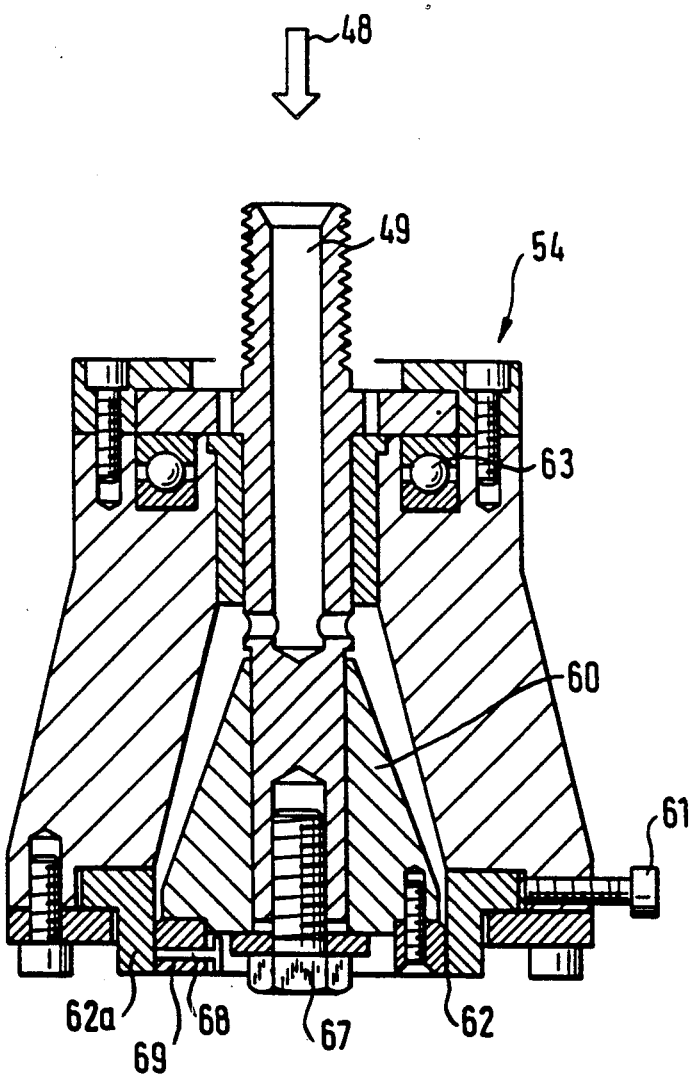
FIG. 7 is a longitudinal section through the ring nozzle in a preferred embodiment.

In FIG. 7 the ring nozzle 54 is shown in a preferred embodiment. A raw mass entering through a conduit 49 into the ring nozzle 54 and indicated symbolically by the arrow 48 is forced into the intermediate space between the inner part 60 of the ring nozzle and the mouthpiece 62*a* of said nozzle. The tobacco sheet emerges from the exit gap 62 of the nozzle 54. The thickness of the tobacco sheet is adjustable via the screw 67. On leaving through the ring gap 62 the tobacco sheet is cut by the cutters in the form of cutting pins 68 into strips of the desired width. In the regions at the ring gap 62 where the greatest differential pressures occur the wearing parts 69, 62*a*, 68 are used which can be replaced relatively easily and quickly. The inner part 60 of the ring nozzle 54 can also easily and rapidly be removed or reinserted from or into the ring nozzle 54 by means of a screw 67 or the like. By using a ballbearing 63 the mouthpiece 62*a* can turn with respect to the inner part 60 or 69. The centering of the adjustable mouthpiece 62*a* is made via adjusting screws 81. The mouthpiece 62*a* itself is likewise mounted in easily detachable manner by means of screws.

Figure 8:
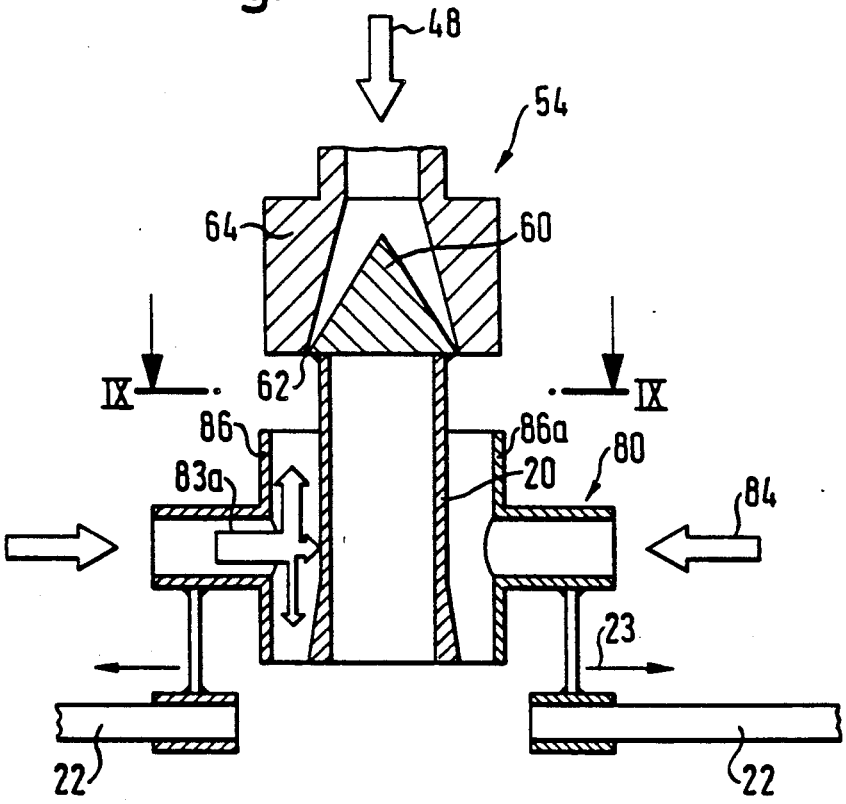
FIG. 8 is a schematic longitudinal section through a further preferred example of embodiment of the ring nozzle and a tubular expansion chamber.
Figure 9:
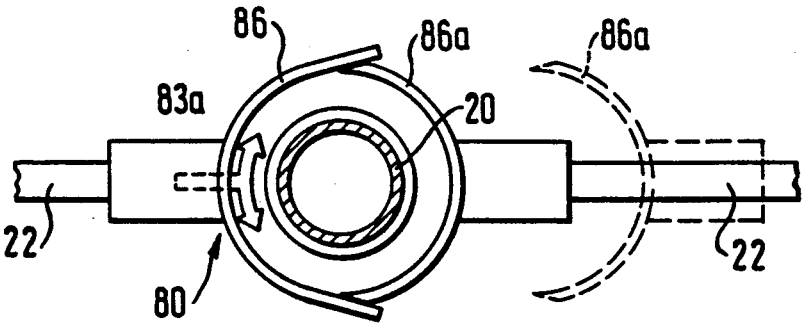
FIG. 9 is a plan view of an apparatus according to FIG. 8.

In FIG. 8 a schematic arrangement is shown similar to that in FIGS. 5 and 6 but in this case the expansion chamber 80 is divided into two halves 82 and 82*a* in the form of half-shells, cf. FIG. 9, which are arranged on guide rails 22 and adapted to be pushed apart in the direction of the arrow 23. By pushing apart the expansion chamber halves 82 the adjustment work on the ring nozzle 54 during the starting and closing down operation of the extruder 52 is made easier. In addition, in the centre in the expansion chamber 80 a tube 20 is disposed which is mounted on the ring nozzle inner part 60. The tube 20 ensures in the expansion chamber 80 an annular hot-gas flow 83*a*. The tube 20 is heated up by the hot air flowing through the sheet strips and provides for the heating of said heat strips from the inner side.

The tube 20 preferably has a conical end. This conical end of the tube 20 ensures that the greater part of the hot air leaves the expansion chamber upwardly. As a result, the sheet strips are only slightly afterdried after leaving the expansion chamber 80. A further advantage of the conical configuration of the end of the tube 20 is the ring nozzle heating by the upwardly emerging hot air. If the ring nozzle 54 is not heated disturbances can occur on exit of the sheet strips from the nozzle gap.

We claim:

1. A tobacco sheet of elevated filling power comprising tobacco particles, water, binder and moisturizer, wherein a) the outer surfaces of the sheet are formed by two relatively gas-impermeable, surface-sealed cover layers;

b) between the cover layers there is a layer of spongy structure; and c) the layer includes a ply of lenticular gas-filled cavities with at least one of shaggy, furrowed and torn surface.

2. A sheet according to claim 1, wherein the proportion of tobacco particles makes up at least about 86–98% by weight with respect to the total mass without water.

3. A sheet according to claim 1, wherein the proportion of moisturizer makes up about 1 to about 6% by weight and the proportion of binder is about 1 to about 8% by weight.

4. A sheet according to claim 1, wherein the binder is selected from the group consiting of acidic, neutral, basic, modified and mixed polysaccharides.

5. A sheet according to claim 1, wherein the cavities have an extent in sheet thickness of about 0.1 mm–5 mm and in sheet width of about 0.1 mm to 10 mm.

6. A sheet according to claim 1, wherein the sheet thickness without taking account of the contribution of the cavities is about 0.1 to 0.4 mm.

7. A method for producing a tobacco-containing sheet of elevated filling power according to claim 1, wherein a) a raw mass having a tobacco content, a content of moisturizers and a binder content is mixed with a water content in the ratio of 80:20 to 60:40,;

b) the moist raw mass is extruded with an extruder at a temperature of about 160° C. under pressure and formed to a tobacco sheet, wherein c) the tobacco content of the raw mass is about 86 to 98% by weight, the moisturizer content about 1 to 6% by weight and the binder content about 1 to 8% by weight;

d) the forming pressure lies between about 10 and 200 bar;

e) the tobacco sheet is strongly heated from both sides after the forming, substantially gas-impermeable cover layers thereby forming on the tobacco sheet; and f) by a further intense supply of heat the water disposed in the tobacco sheet between the cover layers evaporates, gas-filled lenticular cavities and gas-filled bubbles thereby being formed.

8. A method according to claim 7, wherein the first strong heating for forming the gas-impermeable cover layers and the further strong supply of heat are carried out in one process step.

9. A method according to claim 7, wherein the raw mass is pressed through a slot nozzle or a ring nozzle.

10. A method according to claim 7, wherein the cutters provided at the nozzle cut the emerging tobacco sheet into strips which are in particular about 3 to 5 cm wide endless strips.

11. A method according to claim 7, wherein the further intense heat supply is effected by hot air at a temperature of about 200° to 800° C.

12. A method according to claim 7, wherein the further intense heat supply is effected by a medium of suitable energy density such as infrared radiation, microwaves or hot gases.

13. A method according to claim 7, wherein the hot air or gas streams heat the tobacco sheet from both sides.

14. A method according to claim 7, wherein the heat supply is controlled so that the tobacco sheet product retains a residual moisture of about 10 to 20% wet basis.

15. A method according to claim 7, wherein with an extruded hose-like tobacco sheet for the heat treatment method steps substantially the same hot air or hot gas amounts are supplied within the expansion chamber both outside and inside the tobacco sheet.

16. A method according to claim 7, wherein the gap-forming parts of the nozzle are intermittently or permanently displaced or turned with respect to each other.

17. A method according to claim 7, wherein the nozzle is intermittently or permanently subjected to ultrasonic radiation.

18. A method according to claim 7, wherein the gas-impermeability of the cover layers is obtained by bilateral application of thin layers to the tobacco sheet surface before said tobacco sheet is heat treateded in the expansion chamber.

19. A method according to claim 7, wherein propellant or gas-developing chemicals are added to the raw mass.

20. An apparatus for producing a tobacco-containing sheet, comprising a) an extruder having a nozzle, wherein b) the nozzle is followed by an expansion chamber through which tobacco sheet formed by the extruder is led;

c) the expansion chamber is connected to a heat source in such a manner that the tobacco sheet passing through the expansion chamber is intensely heated from both sides so as to form relatively gas-impermeable cover layers, and a spongy intermediate layer having bubbles and lenticular cavities.

21. An apparatus according to claim 20, wherein the extruder is preceded by a mill for grinding large tobacco particles.

22. An apparatus according to claim 20, wherein the nozzle is a ring nozzle or a slot nozzle.

23. An apparatus according to claim 20, wherein the nozzle is provided with cutter blades, cutter pins or the like.

24. An apparatus according to claim 20, wherein the gap-forming parts of the nozzle are intermittently or permanently displaced or turned with respect to each other.

25. An apparatus according to claim 20, wherein with a ring nozzle the outer and inner parts are rotatable with respect to each other via a ball bearing.

26. An apparatus according to claim 20, wherein the gap width is adjustable via a screw.

27. An apparatus according to claim 20, wherein the expansion chamber is provided with at least one connection for the supply of hot gas, in particular hot air.

28. An apparatus according to claim 20, wherein the expansion chamber is connected to a heat source of adequate energy density, for example an infrared radiator or a hot-gas generator.

29. An apparatus according to claim 20, wherein the expansion chamber has a tubular cross-section.

30. An apparatus according to claim 20, wherein the expansion chamber is divided into two half-shell-like halves which are arranged on guide rails and adapted to be pushed apart.

31. An apparatus according to claim 20, wherein in the interior of the expansion chamber a hot-gas supply means is disposed.

32. An apparatus according to claim 27, wherein the connection for the supply of hot air surrounds the expansion chamber substantially annularly.

33. An apparatus according to claim 27, wherein the exit opening of the hot-gas supply means and the exit opening of the hot-gas or hot-gas supply means in the interior of the expansion chamber are so arranged that they lie substantially opposite each other.

34. An apparatus according to claim 30, wherein the hot-gas supply means in the interior of the expansion chamber comprises a lance-shaped hot-gas supply means with a mouthpiece which in the longitudinal direction is inversely symmetrical to the mouthpiece of the hot-air supply means, the hot-gas jet emitted by the hot-gas supply means thereby being substantially in lateral inverted symmetry with the hot-gas jet coming from the hot-air supply means at the outer periphery of the expansion chamber, the tobacco sheet representing the mirror surface of the lateral inversion.

35. An apparatus according to claim 20, wherein to the inner part of the ring nozzle a tube is attached which is disposed centrally in the expansion chamber.

36. A sheet according to claim 2, wherein the proportion of tobacco particles makeup at least about 92% by weight with respect to the total mass without water.

37. A sheet according to claim 3, wherein the proportion of moisturizer makes up 2 to 5% by weight.

38. A sheet according to claim 3, wherein the proportion of binder is 3 to 6% by weight.

39. A sheet according to claim 5, wherein the cavities have an extent in sheet width of 1 to 5 mm.

40. A sheet according to claim 6, wherein the sheet thickness without taking account of the contribution of the cavities is 0.2 –0.3 mm.

41. A method for producing a tobacco-containing sheet of elevated filling power according to claim 7, wherein the content of moisturizes and the binder content mixed with a water content in the ratio of 70:30.

42. A method for producing a tobacco-containing sheet of elevated filling power according to claim 7, wherein the moist raw mass is extruded with an extruder at a temperature up to 140° C.

43. A method for producing a tobacco-containing sheet of elevated filling power according to claim 7, wherein the forming pressure lies between 50 and 100 bar.

44. A method according to claim 11, wherein the further intense heat supply is affected by hot air at a temperature of 300° to 400° C.

45. A method according to claim 19, wherein said propellant or gas-developing chemical is sodium hydrogencarbonate.

46. A method according to claim 19, wherein said propellant is gas-developing chemical is ammonium hydrogen-carbonate.

* * * * *